United States Patent [19]

Santucci

[11] 4,040,452

[45] Aug. 9, 1977

[54] DEVICE FOR HOLDING CUT WEFT THREADS TO BE FOLDED UP INTO THE SHED TO FORM A TUCKED SELVEDGE IN A FABRIC MADE BY A SHUTTLELESS LOOM HAVING A CONTINUOUS WEFT SUPPLY MECHANISM

[75] Inventor: Nicola Santucci, Schio (Vicenza), Italy

[73] Assignee: Nuovo Pignone S.p.A., Italy

[21] Appl. No.: 601,169

[22] Filed: Aug. 1, 1975

[30] Foreign Application Priority Data

Aug. 2, 1974 Italy ..... 25942/74

[51] Int. Cl.[2] ..... D03D 47/36

[52] U.S. Cl. ..... 139/302; 139/434

[58] Field of Search ..... 139/122 R, 122 S, 291 C, 139/302, 303, 430, 434, 453

[56] References Cited

U.S. PATENT DOCUMENTS

| | | | |
|---|---|---|---|
| 3,111,966 | 11/1963 | Demuth | 139/434 |
| 3,380,482 | 4/1968 | Scherillo | 139/302 |
| 3,439,715 | 4/1969 | Juillard | 139/453 |
| 3,563,280 | 2/1971 | Cugini | 139/122 |
| 3,899,008 | 8/1975 | Budzyna | 139/302 |

*Primary Examiner*—Henry S. Jaudon
*Attorney, Agent, or Firm*—Ralph M. Watson

[57] ABSTRACT

The invention relates to a device for holding weft yarns in a shuttleless loom with continuous weft feed and more particularly for holding the cut change thread to be folded up into the shed to form a selvedge in a fabric manufactured on said loom.

The device comprises a plate, adjustably mounted to the lower cutter of the cutting device of the loom, and a leaf spring pressing against said plate, whereby the weft yarn to be cut is gripped therebetween and kept into a taut state, while the weft yarn is being cut and then gripped by the gripping hook for the folding up into the shed. The device further comprises holding means in the form of a bar cooperating with said gripping elements, by which the weft yarns are held and arranged so that all of them are starting from the same position in the hooking zone, and are prevented from becoming entangled with the other weft yarns still attached to the edge of the fabric.

2 Claims, 2 Drawing Figures

DEVICE FOR HOLDING CUT WEFT THREADS TO BE FOLDED UP INTO THE SHED TO FORM A TUCKED SELVEDGE IN A FABRIC MADE BY A SHUTTLELESS LOOM HAVING A CONTINUOUS WEFT SUPPLY MECHANISM

The present invention relates to a device adapted to hold and to keep under tension the cut change thread which is to be folded up into the shed to form a selvedge, particularly adapted for use with a shuttleless loom with a continuous weft supply mechanism. The operation is commonly known as forming a tucked selvedge. The several weft yarns to be weaved are supplied from feeding bobbins mounted outside of the shed and remain attached to the edge of the fabric being formed. By passing the yarn through a selected opening between the two cutters of a cutting device, the yarn is severed from said edge only when it is again inserted into the shed by a carrying gripper. By gripping the weft yarn to be inserted and by sliding onto the sley of the loom, the gripper places said weft yarn between the cutting edges or blades of said cutters, causing the yarn to pass around an ear provided on the lower blade of the lower cutter of the said cutting device.

In the looms of aforementioned type the cut ends of the weft yarns which are beaten into the fabric protrude from the edge of the fabric, thus forming fringes which get entangled with the cord of the other weft yarns, which still remain attached to the edge of the fabric. In order to ensure that a gripping hook is capable of gripping each cut end of the weft yarns or cut change thread and folding it up into the same shed in which the corresponding weft yarn is again inserted in order to obtain a "bridle" or tucked selvedge, having the same pattern of the fabric, as exhaustively described in the Italian patent application No. 30955 A/73, and the corresponding U.S. Patent Application, Serial No. 521,527 filed November 6, 1974, now U.S. patent No. 3,951,177, a device is needed capable of setting said cut change thread free from said cord of the weft threads attached to the edge of the fabric and of keeping it in an extremely taut condition.

U.S. Pat. No. 3,951,177 discloses a gripping device essentially consisting of a pneumatic suction movable nozzle, which must be capable of effecting a rotary and traverse motion in a plane perpendicular to the plane of the fabric being manufactured and parallel to the warp yarns, in order to bring the nozzle into the cutting zone and to cause it to follow the motion of the sley of the loom.

Such a gripping device, besides being of complicated construction to effect the aforementioned said motion, moreover is not very efficient in pneumatically separating the change thread from the cord of the other weft yarns attached to the fabric in the case of a weft of low count and especially a hairy type.

The object of the present invention to overcome the drawbacks of the prior art and thus provide a gripping device which is entirely mechanical and of extremely high structural simplicity, which does not involve any motions and is extremely efficient, whatever type of yarn is processed, since the entangling of the cut change thread with the other weft yarns is prevented, by gripping it before the cutting.

This object is achieved in practice by a mechanical gripping device, which is mounted on the cutting device of the loom, so as to take advantage of the operating characteristics of the same loom, namely of the displacement of the cutters of the said cutting device and the manner in which the weft yarns are placed between the blades of the said cutters.

According to one feature of the present invention, the gripping device comprises a plate which is mounted rearwardly of the ear blade of the lower cutter of the loom cutting device and is fastened to the said cutter by means of the same screws securing said blade. The plate is provided in the upper part, corresponding to the cutting edge of said ear blade, with a gripping surface which is oriented perpendicular to the direction of movement of the said lower cutter. The gripping surface is engaged by a leaf spring, near to said ear, said spring being mounted to the end of a supporting pin, the other end of which is locked between said plate and said blade.

Thus the selected weft yarn, which is being inserted into the shed by the guiding gripper and which is caused to pass around the said ear of the blade of the lower cutter of the cutting device, is inserted between said leaf spring and the gripping surface of the plate. After the cutting, the cut change thread, namely the length of the weft yarn between the edge of the fabric to which it is attached and the blades of the cutters, is therefore kept under tension and in the required position by the said gripping members until a gripping hook, passing under the said change thread and gripping it due to the downward movement of the lower cutter, removes it from the leaf spring and folds it up into the shed.

According to another feature of the present invention, the said pin supporting the leaf spring is locked in place between the plate and the ear blade, by being positioned in a vertical guide slot formed on the surface of the plate facing said blade, so as to permit its height to be adjustable at will with respect to the said gripping surface of the plate and in order to vary as desired the pressure of the said spring against said gripping surface.

Since the several weft yarns coming from the supply bobbins remain attached to the edge of the fabric in different points with respect to the above considered one, and is required that in the hooking zone the cut ends of the weft yarns take all the same arrangement in order to facilitate the hooking operation by the hooking means, according to a further feature of the present invention, the gripping device also comprises a holding member for the weft yarns. The member comprises bar which is rigidly secured at one end to the casing of said cutting device and extends parallel to the edge of the already formed fabric and terminates at the other end near the fell or edge of the fabric being formed, with a portion bent perpendicular and downwardly, acting as a guide for the weft yarns.

Thus the several weft yarns supplied by the feeding bobbins are connected to the edge of the fabric, all turning around the side downwardly bent part of the said holding member, which thereby determines a fixed position from which all the cut change threads start. As a result the yarns are always positioned in the same manner in the hooking zone. On the other hand, according to a further feature of a invention, the present gripping device is mounted on the breast-beam of the loom, so as to be capable of being displaced parallel to the edge of the formed fabric to which the weft yarns remain attached. The position of the said gripping device can be suitably adjusted with respect to the edge of the fabric and the tendency of the weft yarn, beaten by the reed and pressed against the selvedge of the fabric to return due to the elasticity thereof, towards the sley after the beat to reduce the already small hooking area in which the gripping hook is operating, is counteracted.

The invention shall be hereinafter better clarified with reference to the enclosed drawings, which illustrate a preferred embodiment, being merely exemplary of the invention and not limiting in any sense, since technical or constructional variations can be always effected and fall within the scope of the present invention.

Figure 1:
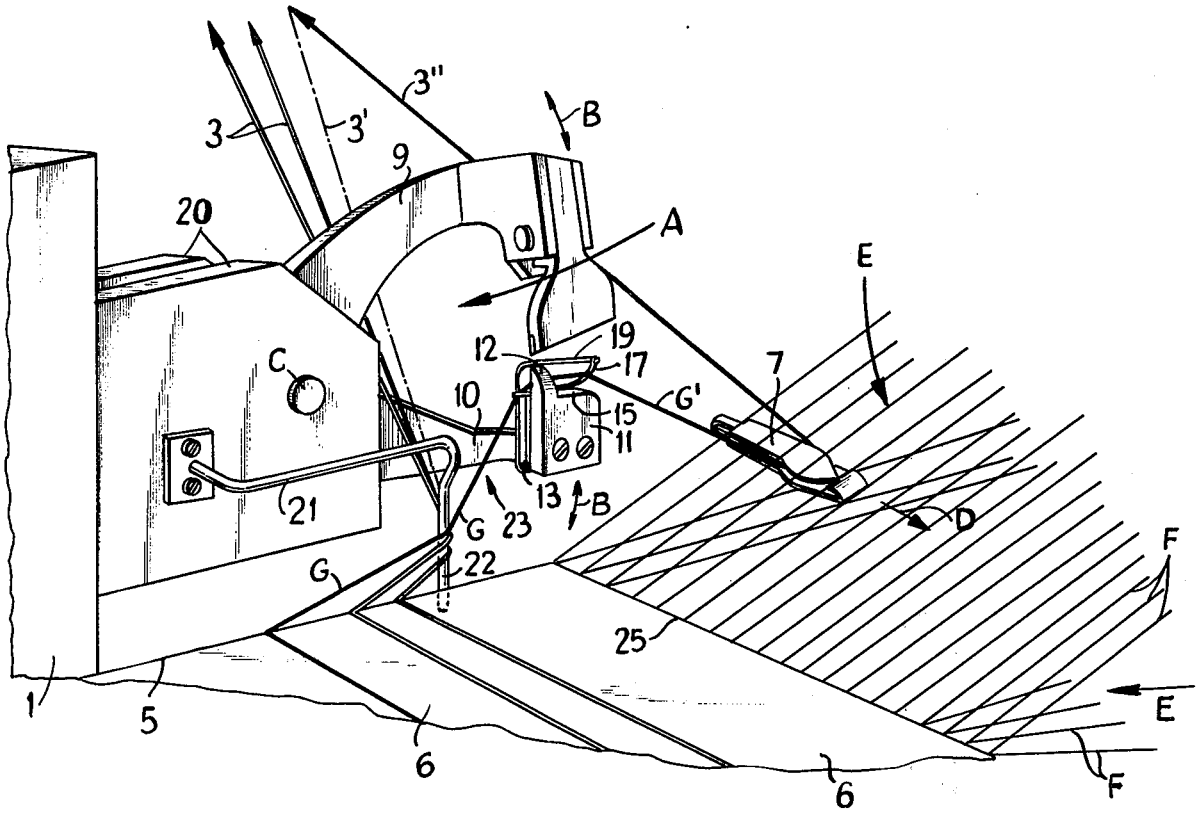
FIG. 1 is a perspective view of the device comprising the present invention.

Referring to the drawings, the numeral 1 indicates the housing for the control mechansims for the cutting device and for the gripping hook, not shown. These mechanisms are similar to those described in previously mentioned U.S. Pat. No. 3,951,177. The numeral 3 indicates the several weft yarns which come from supply bobbins (not shown) external to the shed and pass through the eyelets of a weft selector 4. The weft yarns 3 all remain attached to the edge 5 of the fabric 6 being formed.

Figure 2:
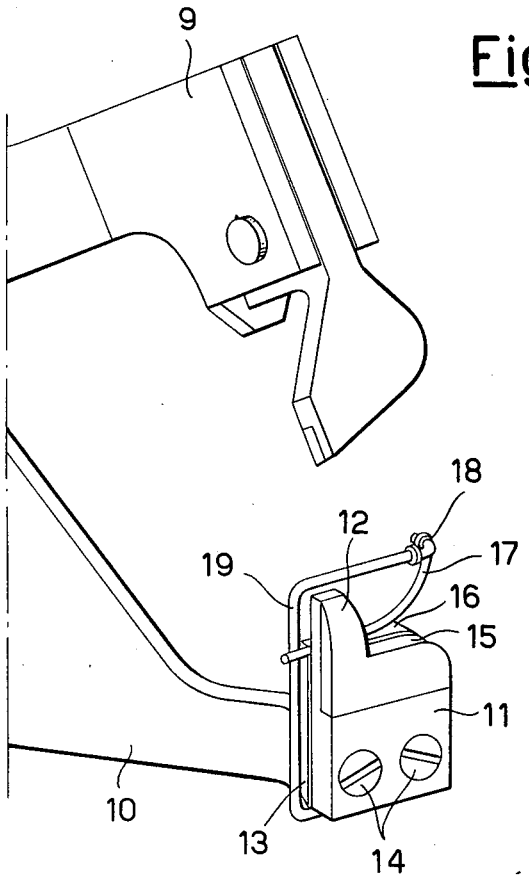
FIG. 2 is a partial side view, on an enlarged scale, of the cutters of the cutting device provided with the gripping device according to the present invention.

The reference numeral 7 indicates the guiding gripper, whereas 8 represents the cover of the template and 9 and 10 respectively indicate the upper cutter and the lower cutter of a cutting device like that already described in U.S. Pat. No. 3,951,177. The lower cutter 10 (see FIG. 2) includes a plate 13 at one end having a blade 11 with a protruding ear 12 mounted thereto. The plate 13 is locked in position on the said cutter 10 by means of the same fastening screws 14 which secure the blade 11. The upper part of the plate 13 provides a gripping surface 16 in line with the cutting edge 15 of the blade 11. The gripping surface 16 which is orientated perpendicular to the direction of movement of the lower cutter 10, cooperates with a leaf spring 17. The leaf spring 17 is mounted to the end 18 of a supporting pin 19 which presses against said cutter at the ear 12. The supporting pin 19, which is essentially G-shaped (see FIG. 2) extends along the side of the blade 11 from the upper part of the ear 12 and is inserted with its shank (not shown) from underneath the plate 13 into a guide slot where it is locked within said slot by tightening the already mentioned screws 14. Thus, by loosening the screws 14 it is possible to have said supporting pin 19 sliding in the said slot and therefore to vary at will the pressure by which the spring 17 presses against said gripping surface 16.

To the fixed part 20 of the said cutting device (see FIG. 1) one end of a holding member 21 for the weft yarns is rigidly secured, said member comprising a main bar portion which extends substantially parallel to the edge 5 of the formed fabric 6 and terminates at the other end, at the fell 25 of the fabric being formed, with a portion 22 perpendicular to the fabric edge 5. Said holding member has the function of ensuring that all the weft yarns 3, even if attached to the edge 5 of the already formed fabric 6 at different points of the latter, are all identically positioned in the hooking zone so as to promote the hooking by the gripping hook, not shown. This occurs since all the yarns 3 are made to pass around the bar portion 22 which thereby determines a fixed position from which all the several cut ends of the weft yarns start extend away from the fabric 6. Thus, when a particular weft yarn 3 is selected, it is in a proper position to be placed in the inserting gripper 7 and with the cooperation of the cutter 11 and associated gripping means 16 and 17 is positioned for tucking in the fabric 6.

Furthermore, the housing 1 is not mounted to the breast-beam 24 of the loom in a fixed position, but it is movable parallel to the edge 5 of the fabric 6 to permit the hooking zone 23 to be suitably positioned with respect to the fell 25 of the already formed fabric 6.

It is immediately evident that such a device greatly facilitates the folding up operation of the ends of the weft yarns into the shed in order to obtain a tucked selvedge. In operation, when a weft yarn 3' is positioned by the selector 4 before the guiding gripper 7, it is hooked and carried by the gripper 7 into the shed formed by the warp yarns, whereby the weft yarn takes the pattern shown by the dashed line 3'' in FIG. 1. The selected weft yarn is forced to pass around the ear 12 of the blade 11 of the lower cutter 10, which in the meanwhile has been raised. The yarn is then inserted between the gripping surface 16 and the spring 17, between which it becomes locked. Thereupon the upper cutter 9 is lowered and the weft yarn is cut. The cut change thread, namely the length of weft yarn between the edge 5 of the fabric 6 and the gripping elements 16 and 17, now cannot become entangled with the cord of the other weft yarns 3. The cut change thread remains taut in the hooking zone 23, as defined between the portion 22 of the holding member 21 and the gripping elements 16 and 17. Simultaneously with the cutting operation, the gripping hook, not shown is displaced by rotating toward the said hooking zone 23, passing under the said cut change thread. Then the lower cutter 10 is lowered and this causes the cut change thread to be hooked to the gripping part of the gripping hook 2 which, in the return stroke, causes the said cut change thread to be folded up into the shed, by removing it from the gripping elements 16 and 17.

FIG. 3 clearly shows that all the weft threads 3 and 3', coming from external bobbins (not shown) and passing through selector 4, remain attached to the edge 5 of the fabric 6 as they pass through the empty area A formed by the cutters 9 and 10 after turning around the vertical part 22 of the holding member 21. On the other hand, the two cutters 9 and 10 can only be rotated in the direction of the arrows B about their common rotation pin C.

Now, when as a weft thread, such as 3', is to be inserted, it is presented by the selector 4 before the leading pincer or gripper 7 which grasps it during its stroke in the direction of the arrow D. Simultaneously, the lower cutter 10 is rotated from its lower position to the working position indicated in the drawing, thus lifting the ear 12. More specifically, FIG. 3 shows the instant of time when the lower cutter 10 is lifted concurrently with the ear 12 and the weft thread 3' is grasped by the pincer 7. The latter gripper 7 is about to enter the open shed E formed by the warp threads F. It is apparent that, as a result of the stroke of the gripper 7 in the direction of the arrow D, the selected weft thread 3' is arranged in the manner indicated by the line 3''. Stated alternatively, the selected weft thread, passing about the vertical portion 22 of the holding member 21, must rotate about the supporting pin 19, the ear 12 and the spring 17.

On the other hand, the guiding gripper or pincer 7 continues its stroke along the direction of D and thus pulls the fixed portion G and G′ of thread which, attached to the edge 5 of the fabric 6, is locked under the grasping members. The other portion of the thread 3″ which goes to the bobbin from the pincer 7, continues, conversely, to be elongated since it is unthreaded from its bobbin by the agency of the pincer 7. The portion G′ of said thread slices along the arcuate portion of the leaf spring 17 and becomes positioned between the surfaces 16 and 17. At this stage, the upper cutter 9 is rotated downwards and severs said thread. The portion G′ of said thread set free by the cutting action is then dragged by the pincer 7 while the other portion G remains held taut between the edge 5 of the fabric 6 and the grasping surfaces 16 and 17.

What I claim is:

1. A device for retaining the cut weft thread to be folded up into the shed to form a tucked selvedge as the selvedge being formed on a shuttleless loom comprising in combination:

a weft cutting device coupled to the loom having upper and lower cutters, a plate mounted on the lower cutter having a planar gripping surface for holding the weft thread in a taut condition after cutting and a cutting edge on said cutter located in the same plane with said surface, a generally rectangular frame member open on one side and having a resiliently biased thread pressing member mounted to the free end of the frame and in engagement with the gripping surface, said other end being adjustably coupled to the plate and capable of adjustment in a direction perpendicular to the gripping surface to regulate the bias of the thread pressing member, and, a holding member for positioning the weft threads to be folded into the shed to form a tucked selvedge comprising an elongated member coupled to the cutting device at one end and having an upper portion extending substantially parrallel to the selvedge and a lower portion extending downwardly therefrom to the other end in a place substantially perpendicular to the edge of the selvedge.

2. A device according to claim 1 wherein:

the plate having the gripping surface thereon includes a vertical groove, said frame member being adjustably mounted with its open vertical side slidable within said groove, and, clamping means for fixing the position of the frame member within the groove and mounting the plate to the lower cutter.

* * * * *

UNITED STATES PATENT AND TRADEMARK OFFICE

CERTIFICATE OF CORRECTION

PATENT NO. : 4,040,452
DATED : August 9, 1977
INVENTOR(S) : Nicola Santucci

It is certified that error appears in the above-identified patent and that said Letters Patent are hereby corrected as shown below:

Column 2, line 3, After "and" insert --of--.

line 47, After "comprises" insert --a--.

line 56, Delete "side" and insert --said--.

Signed and Sealed this

[SEAL]

*Eleventh* Day of *April 1978*

*Attest:*

RUTH C. MASON
*Attesting Officer*

LUTRELLE F. PARKER
*Acting Commissioner of Patents and Trademarks*